United States Patent [19]

Hudgins

[11] Patent Number: 4,601,886

[45] Date of Patent: Jul. 22, 1986

[54] AIR TREATMENT APPARATUS

[76] Inventor: Richard G. Hudgins, P.O. Box GB, Agana, Guam, 96910

[21] Appl. No.: 613,565

[22] Filed: May 24, 1984

[51] Int. Cl.[4] ..... G05B 17/00; A62B 7/00; A61L 9/00

[52] U.S. Cl. ..... 422/116; 422/124; 422/900; 422/305; 422/306

[58] Field of Search ..... 422/124, 123, 120, 900, 422/116, 4, 305, 306

[56] References Cited

U.S. PATENT DOCUMENTS

| | | | |
|---|---|---|---|
| 2,902,834 | 7/1957 | Bosworth, Jr. et al. . | |
| 3,383,179 | 5/1968 | Tibbitts | 422/116 |
| 3,490,436 | 2/1968 | Hart . | |
| 3,616,597 | 11/1971 | Stewart | 23/284 |
| 3,661,323 | 6/1970 | Farris . | |
| 3,758,029 | 6/1972 | Yoshida . | |
| 3,969,479 | 7/1976 | Lonnes et al. | 422/4 |
| 3,985,133 | 10/1976 | Jenkins et al. | 417/415 |
| 4,172,880 | 10/1979 | Tzavos | 422/4 |
| 4,256,710 | 3/1981 | Azuma et al. | 422/4 |
| 4,268,285 | 2/1980 | Mason . | |
| 4,284,005 | 8/1981 | Weigele et al. | 101/363 |
| 4,303,617 | 12/1981 | Bryson | 422/123 |
| 4,304,224 | 12/1981 | Fortney | 422/120 |
| 4,306,892 | 2/1982 | Atalla et al. . | |
| 4,343,765 | 8/1982 | Elston et al. | 422/4 |
| 4,410,339 | 10/1983 | Bachhofer et al. | 422/123 |
| 4,430,658 | 2/1984 | Fukazawa et al. | 346/75 |
| 4,460,552 | 7/1984 | Zakrzewski | 422/4 |

*Primary Examiner*—Barry S. Richman
*Assistant Examiner*—Titus B. Ledbetter, Jr.
*Attorney, Agent, or Firm*—Jack C. Munro

[57] ABSTRACT

An air treatment apparatus operating in conjunction with a conventional type of air conditioning apparatus through which air moves in an air stream. The air treatment apparatus is to be loaded with any one of a plurality of interchangeable cassette type containers. Each container is to contain a particular type of a liquid substance such as an air freshening chemical. The air treatment apparatus is to be electrically controlled to operate through a pump to be dispensed as a plurality of short bursts of the substance within the air stream of the air conditioning apparatus at preselected intervals.

4 Claims, 4 Drawing Figures

AIR TREATMENT APPARATUS

BACKGROUND OF THE INVENTION

The field of this invention relates to the dispersement of a volatile substance into a designated air space and more particularly to an air treatment apparatus which is to be used in combination with a conventional air conditioning apparatus to achieve this dispersement of the substance within the atmosphere of the designated air space.

The use of air conditioning apparatuses within a confined area is well-known. Air conditioning apparatuses are used within the home and office as both centrally located units and also as window located units. Also, air conditioning apparatuses are located within the interior of automobiles.

Some forms of air conditioning apparatuses use an air movement device such as a fan which pushes air from within a confined area (or from the ambient), through a filter, across coils which either cool the air or heat the air and then discharge such into the confined area. The total comfort concept which is used by most air conditioning apparatuses encompasses heating, cooling, humidification and air cleaning. Air cleaning is achieved through the filter which is used to remove large particulates such as street and house dust as well as submicronic size particulates such as tobacco smoke and typical airborne bacteria and viruses.

However, most air conditioning systems at the present time ignore an air quality problem and that is offensive odors resulting from normal environmental living conditions. Through use of a conventional air conditioning system, a modern building or motor vehicle which is built to current total comfort standards could be warm in winter, cool in summer, provide ideal humidity levels at all times, be practically void of dust, pollen, smoke, insects and noise, and yet be permeated with offensive odors. Typical offensive odors within a home are cooking odors, floor wax, wallpaper, drapes, cigarette smoke, plumbing drains, trash cans, etc.

Within a single confined area, a human being will become immune to given low level odor, such as a common household odor. After sustained exposure to that odor the human being may conclude that the house (or automobile) is in an odor free condition. Therefore, anyone else entering the house can quickly ascertain that such an odor does exist and may find that odor most undesirable.

In order to remove conventional household odors it is common to use what is termed an air freshener. A popular air freshener is an aerosol container and is to be sprayed around rooms of a house, or office, or within the interior of an automobile or other confined space. Such air fresheners are generally two types, those being which mask odors and those which remove odors. However, both types are in no way associated with the air conditioning apparatus which is utilized within the confined area.

Previously there has been attempts as to including within an air conditioning apparatus some form of air freshening means. It has been known to supply air freshener chemicals to a filter and as the air is passed through the filter of the air conditioning apparatus, the air freshener will inherently be dispensed into the air stream. Unfortunately, this type of arrangement provided little or no control over the amount of air freshener that was being dispensed in the air nor was there any control as to the length of time that the air freshener was supplied into the air. The same is true in the using of any gel used in conjunction within the housing of the air conditioning apparatus. Neither of these basic systems provide for interchangeable air freshener units.

SUMMARY OF THE INVENTION

One of the objects of the present invention is to provide a form of control over the dispensing of an additive to the air within a confined area. This control relates not only to the quantity that is dispensed into the air but also as to the length of time that the substance is dispensed into the air. Also, it is desirable to provide for adjustment of both the quantity that is dispensed and again at what interval the substance is dispensed according to an individual's desires.

Another objective of this invention is to give the user a selection of different types of air treatment substances. In other words, the user at one time may select a substance which has the odor of pine needles which may be a satisfactory odor during the holidays. While at other times, such a summertime, the user may select a substance which has the odor of ocean breeze. It is an objective to offer to the user a wide variety of different types of odors for selection.

It is another objective of this invention to utilize an air treatment apparatus to obtain a salubrious environment. In other words, people afflicted with undesirable health conditions, such as asthma, emphysema, and the like, may find it desirable to include some type of medicament in conjunction with the substance emitted into the air. Not only can a medicament be supplied into the air but also moisture droplets may be added into the air to increase humidity to treat an individual who may be ill with a cold or the flu.

The primary objective of the present invention is to incorporate an air treatment apparatus in conjunction with a forced air ventilation system which supplies air to a confined space which is the interior of a home, office or automobile. Another objective of this invention is to incorporate the control of the air treatment apparatus directly in conjunction with the forced air ventilation system and this control to be operated by the occupant of the confined space.

The structure of this invention is to include the concept of a cassette type of module. Each cassette includes a chamber. Within that chamber is to be located a quantity of a liquid substance. The quantity of liquid substance could be a medicament, water, as well as a wide variety of odoriferous liquids. This cassette is to be removably engaged within a cassette receiving chamber associated with the conventional air conditioning apparatus housing. Also incorporated within the air conditioning apparatus housing is a pump and a tube. This tube includes a series of orifices.

Also incorporated with the air treatment apparatus is an electrically operated control panel. By pushing appropriate buttons on the control panel, the operator can activate the pump to move the liquid from the cassette to the tube to be dispensed through the orifices of the tube in the form of a fine mist or spray. By selecting which buttons to push, the operator can manually dispense the substance from the tube into the air stream or can automatically cause dispensing of such. Automatic dispensing can further be controlled to occur repetitiously in certain time intervals, such as every fifteen minutes, every thirty minutes, or every sixty minutes.

DETAILED DESCRIPTION OF THE SHOWN EMBODIMENT

Figure 1:
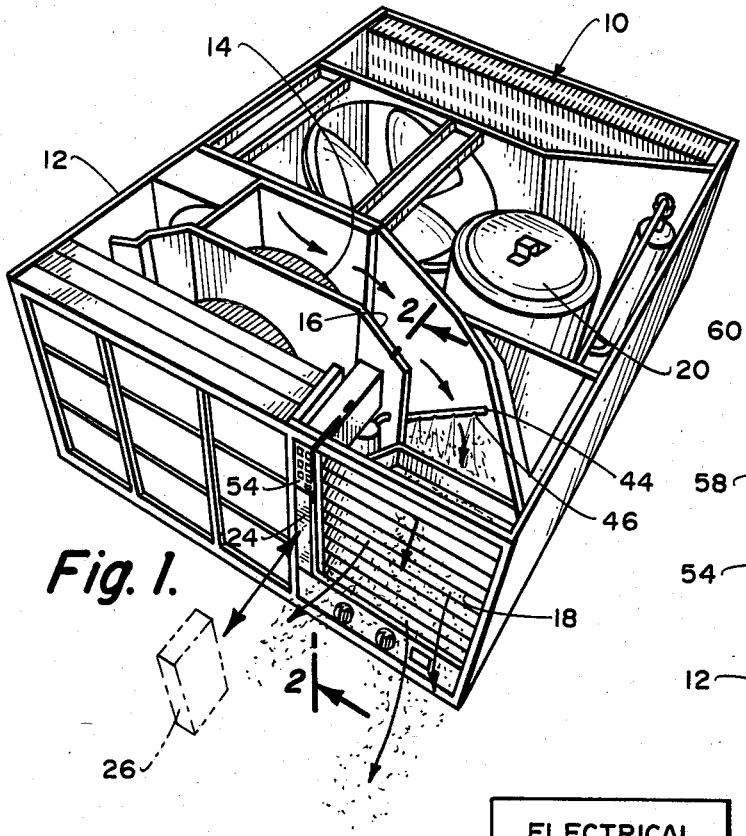
FIG. 1 is an isometric view, partially broken away, of a conventional air conditioning apparatus within which has been installed the air treatment device of the present invention.
Figure 3:
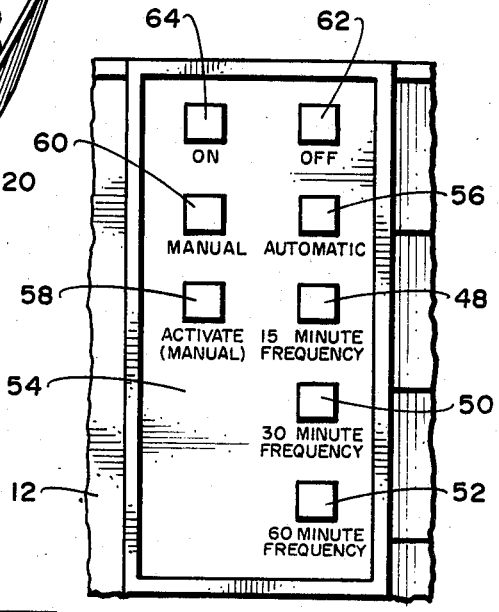
FIG. 3 is a front plan view of the electrical control panel which is mounted in conjunction with the housing of the air treatment apparatus of the present invention taken along line 3—3 of FIG. 2.
Figure 2:
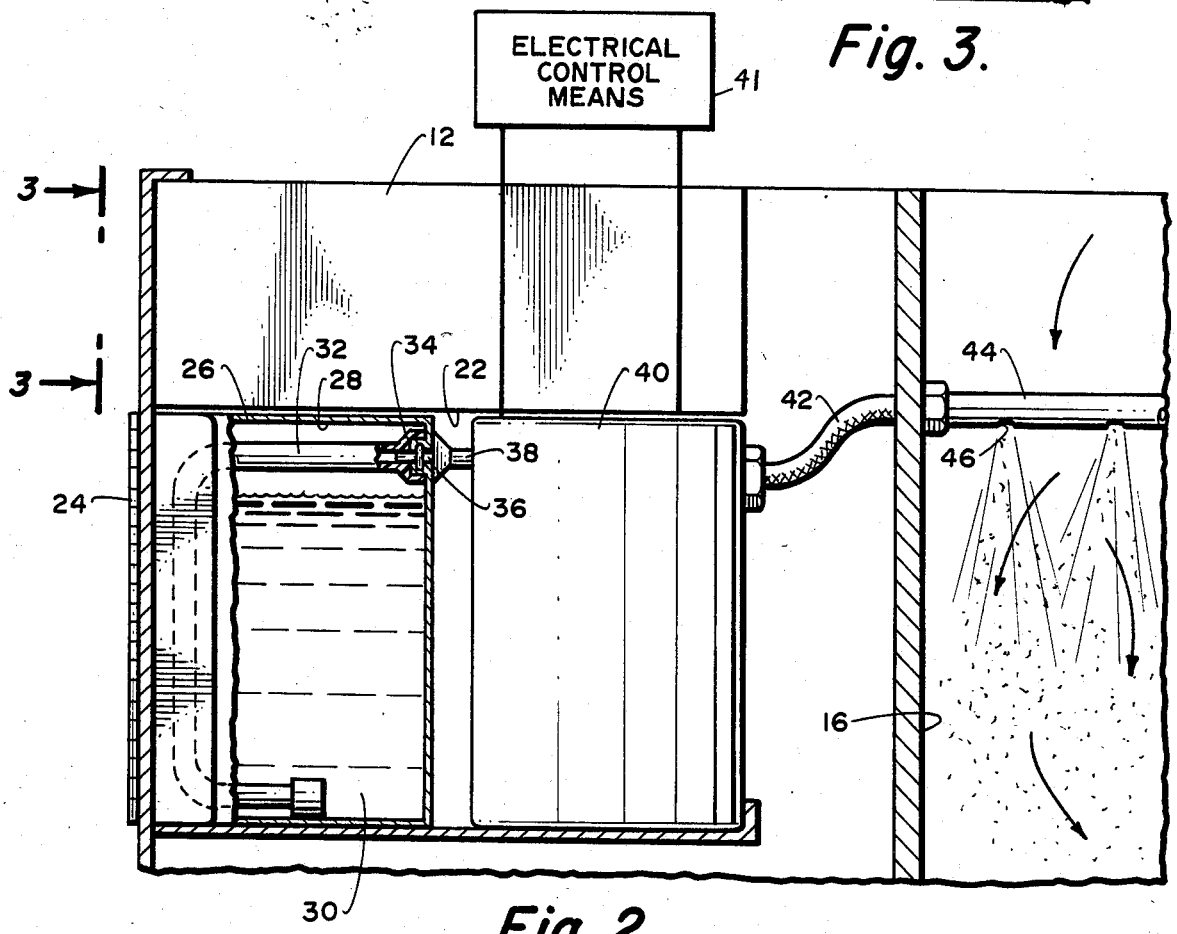
FIG. 2 is a cross-sectional view taken along line 2—2 of FIG. 1 showing in more detail the air treatment apparatus of this invention.
Figure 4:
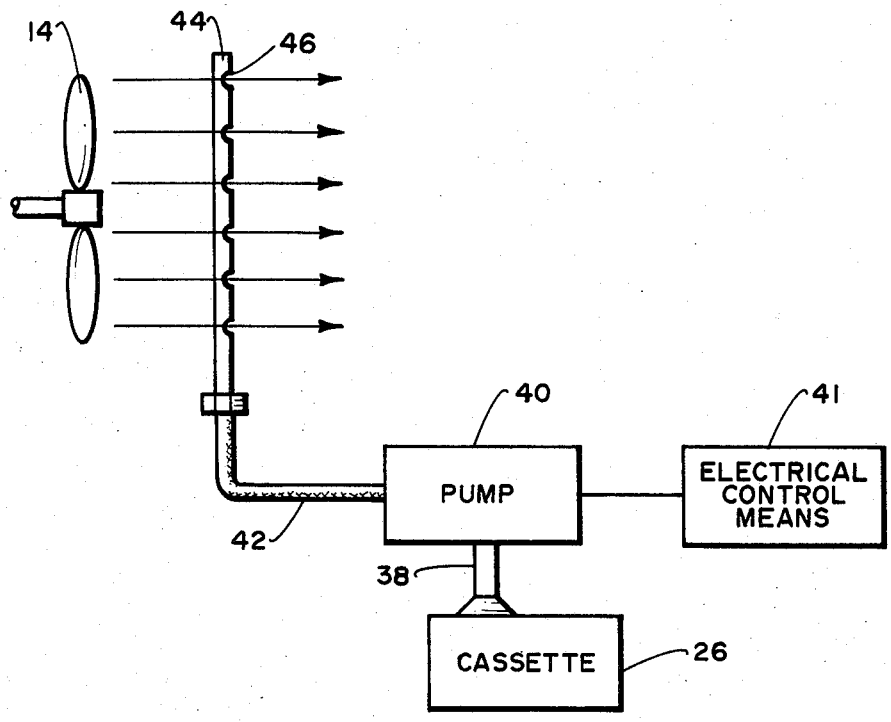
FIG. 4 is a schematic view depicting usage of this invention within an airstream but not within a duct.

Referring particularly to the drawing there is shown in FIG. 1 a conventional air conditioning apparatus 10. For the purposes of illustration of this invention, what is frequently termed a window air conditioning unit is shown. However, it also is to be considered within the scope of this invention that the apparatus of the present invention could be included within air conditioning devices of other types such as a central air conditioning system within a home or office as well as also an air conditioning system within a mobile home as well as an air conditioning system within an automobile or truck. Also, it is considered within the scope of this invention to use the air treatment apparatus in conjunction with any air movement device such as a fan or humidifier. Generally, depiction of usage with a fan is shown in the schematic view of FIG. 4.

The air conditioning apparatus 10 includes a housing 12 and an air movement device such as a fan 14. Air conditioning apparatus 10 also includes a duct 16 through which the air from the fan 14 is to be conducted and passed through a grate 18 which is mounted within the front face of the housing 12. The air from the grate 18 is conducted within the confined area such as the interior of the home. Included within the air conditioning apparatus is a conventional compressor 20 as well as other necessary equipment which is not deemed to be specifically a part of the present invention. It is to be understood that the compressor 20 as well as the fan 14 will be driven by a conventional energy source such as electricity.

Incorporated within the front face of the housing 12 is a cassette receiving chamber 22. Cassette receiving chamber 22 is normally covered by means of a hinged door 24 within the front panel of the housing 12. The door 24 is to be moved to an open position to permit entry into the cassette receiving chamber 22 of a cassette 26.

Cassette 26 is basically a rectangularly shaped, box-like sheet material structure which includes an internal chamber 28. Within the internal chamber 28 is to be contained a quantity of a liquid substance 30. A tube 32 is located within the cassette internal chamber 28 with one end of the tube 32 being open and located against the bottom wall of the cassette 26 and the opposite end of the tube 32 being located adjacent the upper wall of the cassette 26. The portion of the tube 32 adjacent the upper wall of the cassette 26 includes a valve assembly 34. The valve 34 is to be engageable with a male section 36 of an outlet tube 38. The outlet tube 38 connects to a pump 40. A discharge tube 42 extends from the pump 40 and connects with a dispensing tube 44. The dispensing tube 44 is fixedly mounted within a portion of the housing 12. The tube 44 includes a series of orifices 46. The tube 44 is located within the duct 16 and connects with the air passing therethrough. The orifices 46 are positioned so as to discharge in fine spray form the liquid 30 in a direction down stream as the air is passed through the duct 16.

Pump 40 is to be driven electrically from the same source that drives the fan 14 and the compressor 20. Electrical control means 41 controls the operation of pump 40. With the pump 40 being operated, a small stream of the substance 30 is conducted through the tube 32, through outlet tube 38 and into discharge tube 42 to be dispensed from orifices 46 of the dispensing tube 44. Dispensing of the substance from the orifices 46 is only during operation of the pump 40. Pump 40 is to be the type of pump that can be momentarily and often operated and turned off without causing harm to the pump. This is so that three or four in number of short bursts of the substance 30 is to be dispensed from the orifices 46 at each selected interval of time. Desirable intervals of time at which the three or four short bursts are to be dispensed would be every fifteen minutes, every thirty minutes, or every sixty minutes. The operator can select whatever desired time period for this dispensing if the operator pushes the appropriate respective button 48, 50 or 52. The buttons 48, 50 and 52 are mounted within a control panel 54 mounted within the front end of the housing 12.

In order for the operator to achieve this automatic dispensing of the substance at the desired intervals of fifteen minutes, thirty minutes, or sixty minutes, the operator must also push button 56 which is denoted as automatic. The operator having now pushed button 56 and either the desired button 48, 50 or 52, as long as the air conditioning apparatus 10 is operable, such automatic dispensing of the substance from the orifices 46 will occur.

Also included within the control panel 54 are buttons 58 and 60. With the operator pushing button 58, the mode of operation is changed from automatic to manual. During manual activation, any time the operator then pushes button 60, a burst of a substance 30 from the orifices 46 will occur. As long as the operator continues to press button 60, the pump 40 will be operated and therefore a continuous steady stream of the substance from the orifices 46 will occur. The buttons 48, 50, 52, 56, 58, 60, 62 and 64 operate through the electrical control means 41.

Also included on the control panel 54 is button 62. Activation of button 62 will cause the air treatment apparatus of this invention to be deactivated. If it is desired to again reactivate the air treatment apparatus, the operator only need to push button 64 which permits the air treatment apparatus to be operated. The air treatment apparatus of this invention is operable only when the air conditioning apparatus 10 is operated.

It is generally considered that the cassettes 26 will be discarded after such become empty. However, it is also to be considered within the scope of this invention that the cassettes can be refilled.

It is considered that many different types of substances 30 could be utilized such as liquids that would resemble clean air of the sea and the mountains, any perfume, as well as any other desirable odor such as the odor of a new car.

What is claimed is:

1. In combination with an air conditioning apparatus, said air conditioning apparatus having a housing, air movement means mounted within said housing, said air movement means producing an air stream, an air treatment apparatus being in fluid communication with said air stream, said air treatment apparatus being for emitting an atomized substance into said air stream, said air treatment apparatus comprising:

orifice dispensing means located within said air stream;

a cassette receiving chamber formed within said housing for enclosing and securing a source means therein;

conduit connection means comprising a male section and a female section;

source means containing a quantity of a substance in liquid form, said source means comprising a cassette, said cassette having a valve assembly, said valve assembly being mounted within an outlet tube having a connection end comprising said female section, mounted within said cassette, said cassette being removably connected to said male section by said connection means so that said male section is engageable with said valve assembly, said cassette being located within said cassette receiving chamber when it is connected to said male section; and pump means mounted within said housing, said pump means being fluidly connected to said source means via an inlet tube connected to said female section and said pump means also being fluidly connected to said orifice dispensing means, said pump means being for moving said substance from said cassette past said valve assembly into said inlet tube to said orifice dispensing means so that it is emitted therefrom as a fine spray.

2. The combination as defined in claim 1 including:

electrical control means connected to said pump means, said electrical control means being manually activatable to activate said pump means, said electrical control means including time interval variation means to select a specific desired time interval from a plurality of different time intervals at which said pump means would be activated resulting in emitting said atomized substance into the air within said air stream.

3. In combination with an air conditioning apparatus, said air conditioning apparatus having a housing, air movement means mounted within said housing, a duct assembly included within said housing, said duct assembly being for receiving air from said air movement means and directing such into ambient air, and an air treatment apparatus connected to said duct assembly, said air treatment apparatus being for emitting an atomized substance into the air as the air passes through said duct assembly, said air treatment apparatus comprising:

orifice dispensing means located within said duct assembly;

a cassette receiving chamber formed within said housing for enclosing and securing a source means therein;

conduit connection means comprising a male section and a female section;

source means containing a quantity of a substance in liquid form, said source means comprising a cassette, said cassette having a valve assembly, said valve assembly being mounted within an outlet tube having a connection end comprising said female section, said outlet tube being mounted within said cassette, said cassette being removably connected to said male section by said connection means so that said male section is engageable with said valve assembly, said cassette being located within said cassette receiving chamber when it is connected to said male section; and pump means mounted within said housing, said pump means being fluidly connected to said source means via an inlet tube connected to said female section and said pump means also being fluidly connected to said orifice dispensing means, said pump means being for moving said substance from said cassette past said valve assembly into said inlet tube to said orifice dispensing means so that it is emitted therefrom as a fine spray.

4. The combination as defined in claim 1 including:

electrical control means connected to said pump means, said electrical control means being manually activatable to activate said pump means, said electrical control means including time interval variation means to select a specific desired time interval from a plurality of different time intervals at which said pump means would be activated resulting in emitting said atomized substance into the air within said duct assembly.

* * * * *